137-13 3R
11/28/78 OR 4,127,138

United States Patent [19]
Sweeney

[11] 4,127,138
[45] Nov. 28, 1978

[54] FUEL OIL BLENDING TO IMPROVE POUR REDUCTION

[75] Inventor: William M. Sweeney, Wappingers Falls, N.Y.

[73] Assignee: Texaco Inc., New York, N.Y.

[21] Appl. No.: 854,298

[22] Filed: Nov. 23, 1977

[51] Int. Cl.[2] ..... F17D 1/16; F17D 1/17
[52] U.S. Cl. ..... 137/13; 44/62; 44/70
[58] Field of Search ..... 44/62, 70; 526/331; 137/13

[56] References Cited

U.S. PATENT DOCUMENTS

| | | | |
|---|---|---|---|
| 3,776,247 | 12/1973 | Choufoer et al. | 137/13 |
| 3,830,761 | 8/1974 | Lenney | 526/331 |
| 3,904,579 | 9/1975 | Braddicks | 526/331 |
| 3,915,668 | 10/1975 | Basalay et al. | 44/62 |
| 4,050,742 | 9/1977 | Hughes et al. | 137/13 |

*Primary Examiner*—Winston A Douglas
*Assistant Examiner*—Y. Harris-Smith
*Attorney, Agent, or Firm*—Carl G. Ries; Thomas H. Whaley; Walter D. Hunter

[57] ABSTRACT

A low pour point fuel oil composition is prepared from a major amount of a high pour point, low sulfur, waxy, residual fuel and a minor amount of low wax, low pour, residual fuel oil by adding thereto from 0.01 to 0.5% by weight of an oil soluble terpolymer such as vinyl acetate-ethylene-vinyl chloride or allyl chloride having a number average molecular weight of about 4,000 to about 70,000. The copolymer may be added either in a water-glycol emulsion or in a hydrocarbon to one of the blend components which has been heated to between about 25° to 150° C. In another aspect, this invention relates to a process for the pipeline transportation of the low pour fuel oil compositions previously described.

11 Claims, No Drawings

FUEL OIL BLENDING TO IMPROVE POUR REDUCTION

BACKGROUND OF THE INVENTION

1. Field of the Invention

This invention is concerned with means for providing a low sulfur, low pour fuel oil composition. More particularly, the invention is concerned with a fuel oil composition containing a major amount of a high pour, low sulfur, waxy residual fuel and a minor amount of a low wax, low pour, residual fuel oil, this blend having a reduced pour point relative to its components owing to the incorporation therein of a minor amount of an oil-soluble terpolymer.

2. Description of the Prior Art

As is well known, residual fuel oils contain quantities of wax and asphaltic compounds which render them viscous and which sometimes interfere with practical use thereof. Particularly serious problems can be encountered in pumping residual fuel oils to a burner and in making them flow at low temperatures. Other factors to be reckoned with in regard to these oils are the facts that they behave as non-Newtonian liquids at low temperatures; exhibit variable solidifying temperatures and manifest peculiar hysteresis phenomena — all of which result in difficulties in equipment design.

One approach used in making these oils easier to handle has been to subject them to fairly lengthy and costly dewaxing procedures.

Another approach which has been suggested and tried in order to bring the viscosity of residual fuel oils to suitable levels has been to dilute or "cut" them with a major amount of lighter distillate oils. This procedure is expensive because of the considerably higher cost of the distillate oils relative to that of residual oils.

In recent years it has been recommended to incorporate additives in lubricating oils and in so-called middle distillates in order to tie in the wax present therein and to improve flow characteristics at reduced temperatures. The additives in question consist either of compounds formed by alkylating benzene or naphthalene derivatives; or, of copolymers of ethylene-vinyl fatty acid ester of a molecular weight up to 3,000 containing from 15 to 25 percent by weight of the vinyl fatty acid ester.

The main object of the present invention, accordingly, is to provide for critical blending of high pour waxy residual fuel oils with low wax, low pour residual fuel oils to give large increases in pour reduction without employing elaborate dewaxing procedures.

An equally important object of the claimed invention is to provide a novel fuel oil blend characterized by a low sulfur content and a reduced pour point resulting from the incorporation therein of a small amount, for example, a terpolymer of vinyl acetate, ethylene and vinyl chloride.

A further object of the claimed invention is to provide a fuel oil blend which will be stable at different blend temperatures over prolonged storage times.

BRIEF DESCRIPTION OF THE INVENTION

In its broadest aspect this invention relates to fuel oil compositions having low pour points comprising a major amount of a high pour, low sulfur, waxy residual fuel and a minor amount of a low wax, low pour residual fuel containing an effective pour depressant amount of an oil-soluble terpolymer. The terpolymer used in preparing the crude oil compositions of this invention is a vinyl acetate-ethylene-vinyl chloride or allyl chloride terpolymer. In another aspect this invention relates to a process for the pipeline transportation of the above-described fuel oil compositions.

DETAILED DESCRIPTION OF THE INVENTION

The fuel blend of the invention comprises a major amount (i.e. over 50 percent by volume) of a high pour, waxy, residual fuel oil having an API gravity of about 20.0 to about 25.0; a sulfur content of between about 0.40 wt. % and about 0.96 wt.%; a Furol viscosity at 122° F of about 60 to about 230; (a powy point of between 65° and 125° F;) a flash point of between about 300° and 50° F, with a wax content of between about 10 and 20 percent; and a minor amount (i.e. less than 50 percent by volume) of a low waxy, low pour residual fuel oil having an API gravity of about 10.0 to about 15.0; a Furol viscosity at 122° F of about 150 to about 250; a flash point of about 220° to about 350° F; a pour point of between about 25° F and about 45° F; a wax content of between about 2 and 5 weight percent with a sulfur content of between about 0.50 and about 0.90 weight percent. A waxy, low pour residual fuel oil which has given particularly good results as the minor constituent of the claimed blend is that known as Louisiana No. 6 Fuel Oil which has an API gravity of about 12.3, a Furol viscosity of 207.0 at 122° F, a pour point of about 40° F and a wax content of about 3 percent.

Preferably, the residual fuel oil compositions of this invention will contain about 55 to about 85 volume percent of the high pour, low sulfur, waxy residual fuel; about 45 to 15 volume percent of low wax, low pour residual fuel and about 0.01 to about 0.5 weight percent of the oil-soluble terpolymer.

Oil-soluble terpolymers useful in preparing the crude oil compositions of this invention comprise recurring units of:

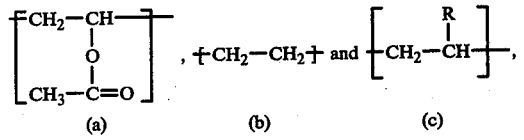

(a) (b) (c)

wherein R is selected from the group consisting of —Cl or —$CH_2Cl$.

The number average molecular weight of the terpolymer utilized in this invention as previously described will range from about 4000 to about 70,000 or more and, preferably, will be from about 15,000 to about 30,000 as determined by vapor pressure osmometry.

In the vinyl acetate-ethylene-vinyl chloride or allyl chloride terpolymers the weight percent of the a units (i.e., vinyl acetate units) is about 15 to about 40; the weight percent of c units (i.e., vinyl chloride or allyl chloride units) is about 0.5 to about 5.0 with the b units (i.e., ethylene being balance.

Preparation of the vinyl acetate-ethylene-vinyl chloride terpolymer is conducted using processes well known in the art. For example, ethylene, vinyl acetate, vinyl chloride and benzene are fed continuously into a stirred reactor at a temperature of from about 70° to about 120° C and under pressures ranging from about 1000 to 5000 psig. A variety of catalysts may be utilized however, a preferred catalyst is azobisisobutyronitrile which is added as a benzene solution at the rate of about 0.5 to 2.0 lbs./1000 lbs. of polymer. Residence time in the reactor is about 0.1 to about 1.0 hours or more. After the reaction mixture is removed from the reactor, the solvent and unreacted stargin materials are stripped off yielding the terpolymer product.

The amount of the terpolymer pour depressant incorporated into the fuel compositions of this invention may be varied over a wide range. Generally the amount of the terpolymer in the residual fuel oil composition will vary from about 0.01 to about 0.50weight percent and preferably between about 0.01 to about 0.15 weight percent.

The required amount of vinyl acetate-ethylenevinyl chloride or allyl chloride terpolymer may be added with mixing directly to the residual fuel which preferably heated. Preferably, the terpolymer is added to the residual fuel in solution form dissolved in a hydrocarbon such as benzene, toluene, xylene, etc., at a temperature of about 25° to about 120° C with mixing. Generally, the concentration of the terpolymer in the hydrocarbon solution will range from about 0.5 to about 10 or more weight percent.

The following example illustrates one embodiment of this invention and is to be considered not limitative.

EXAMPLE I

Ethylene, vinyl acetate, vinyl chloride and benzene are fed continuously at rates of 10.01, 4.49, 0.01 and 2.70 lbs./hr. respectively into a 2 liter stirred reactor maintained at a temperature of 80°-110° C at 4000 psig. Azobisisobutyronitrile is employed as the catalyst and is introduced into the reactor as a benzene solution at the rate of 0.8 lbs./1000 lb. of polymer. The residence time in the reactor is 15 minutes. After the reaction mixture is removed from the reactor it is stripped of solvent and unreacted materials yielding the terpolymer product. The composition of the terpolymer is 28 weight percent vinyl acetate, 0.7 weight percent of vinyl chloride and 71.3 weight percent ethylene with a number average molecular weight of about 20,000 as determined by vapor pressure osometry.

A fuel oil composition is prepared by mixing at 60° C for 1 hour 60 percent by volume of F/18 residual fuel, about 40 percent by volume of Louisiana No. 6 fuel oil and a sufficient amount of the above prepared terpolymer so that the concentration of the terpolymer is 0.125 weight percent. The pour point of this composition is determined by the method of ASTM D-97 and found to be substantially below that of the same fuel oil mixture without terpolymer which exhibits a pour point of 80° F. The pour point of the F/18 residual fuel alone is 95° F while the pour point of the Louisiana No. 6 residual fuel alone is 30° F.

In another aspect, this invention relates to an improved process for the transportation of the novel fuel oil compositions described in detail above.

The improved process of this invention for the pipeline transportation of the fuel oil composition described above comprises introducing into the said pipeline a fuel oil composition comprising a major amount of a high pour point, low sulfur, waxy, residual fuel, a minor amount of a low wax, low pour, residual fuel oil and an effective pour depressant amount of one of the useful terpolymers of this invention, such as the vinyl acetate-ethylene-vinyl chloride or allyl chloride terpolymer. Generally, the amount of the terpolymer will range from about 0.01 to about 0.50 weight percent.

What is claimed is:

1. A fuel oil composition having improved pour point characteristics comprising a major amount of a high pour point, low sulfur, waxy residual fuel, a minor amount of a low wax, low pour residual fuel and an effective pour depressant amount of an oil-soluble terpolymer comprising recurring units of:

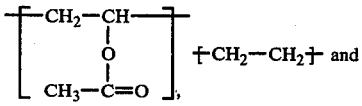

and

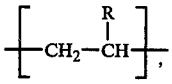

wherein R is selected from the group consisting of —Cl and —$CH_2Cl$.

2. The composition of claim 1 wherein the said terpolymer comprises about 15 to about 40 weight percent vinyl acetate, from about 0.5 to about 5.0 weight percent vinyl chloride with the balance being ethylene.

3. The composition of claim 1 wherein the said terpolymer comprises about 28 percent by weight vinyl acetate, about 0.7 percent by weight of vinyl chloride with the balance being ethylene.

4. The composition of claim 1 wherein the number average molecular weight of the said terpolymer will range from about 4000 to about 70,000.

5. The composition of claim 1 wherein the number average molecular weight of the said terpolymer will range from about 15,000 to about 30,000.

6. The composition of claim 1 containing about 60 percent by volume of the said high pour fuel oil and about 40 percent by volume of the said low pour fuel oil.

7. A solution of an oil-soluble terpolymer comprising recurring units of:

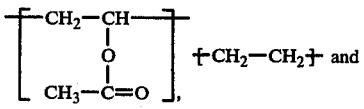

and

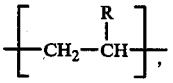

wherein R is selected from the group consisting of —Cl and —$CH_2Cl$ in a hydrocarbon selected from the group consisting of benzene, toluene and xylene.

8. The solution of claim 7 wherein the concentration of the said terpolymer ranges from about 0.5 to about 10 weight percent.

9. In the transportation of crude oils, the improvement which comprises introducing into a pipeline the a crude oil composition comprising a major amount of a high pour point, low sulfur, waxy residual fuel, a minor amount of a low wax, low pour residual fuel and an effective pour depressant amount of an oil-soluble terpolymer comprising recurring units of:

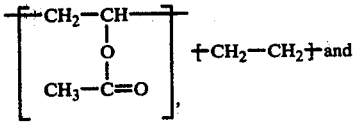

-continued

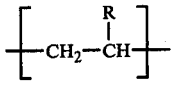

wherein R is selected from the group consisting of —Cl and —$CH_2Cl$.

10. The process of claim 9 wherein the said terpolymer comprises about 15 to about 40 weight percent vinyl acetate, from about 0.5 to about 5.0 weight percent vinyl chloride with the balance being ethylene.

11. The process of claim 9 wherein the said terpolymer comprises about 28 percent by weight vinyl acetate, about 0.7 percent by weight of vinyl chloride with the balance being ethylene.

* * * * *